United States Patent [19]

Stange et al.

[11] 4,060,233

[45] Nov. 29, 1977

[54] CASSETTE LOADED SHEET FEEDER FOR REPRODUCTION MACHINE

[75] Inventors: Klaus K. Stange, Pittsford; Thomas J. Hamlin, Macedon, both of N.Y.

[73] Assignee: Xerox Corporation, Stamford, Conn.

[21] Appl. No.: 737,450

[22] Filed: Nov. 1, 1976

[51] Int. Cl.[2] ..... B65H 1/12; B65H 3/04

[52] U.S. Cl. ..... 271/160; 271/34; 271/127; 271/164; 271/167

[58] Field of Search ..... 271/34, 160, 164, 162, 271/127, 117, 167, 169, 170, 121, 124, 125

[56] References Cited

U.S. PATENT DOCUMENTS

| | | | |
|---|---|---|---|
| 3,689,064 | 9/1972 | Kuksa | 271/164 |
| 3,768,803 | 10/1973 | Stange | 271/34 |
| 3,873,196 | 5/1975 | Ogawa | 271/170 X |
| 3,883,133 | 5/1975 | Rebres | 271/164 X |

*Primary Examiner*—Bruce H. Stoner, Jr.

[57] ABSTRACT

A cassette type sheet handling mechanism for a reproduction machine wherein the sheet separator utilized to remove sheets singly from the cassette has a portion thereof permanently mounted in the cassette for removal from the machine when the cassette is removed therefrom, the bottom of the cassette being pivotally mounted and biased in a direction toward the sheet separator to maintain the top sheet in the stack against the sheet separator.

3 Claims, 4 Drawing Figures

CASSETTE LOADED SHEET FEEDER FOR REPRODUCTION MACHINE

BACKGROUND OF THE INVENTION

With the advent of convenience copiers adapted to produce copies of a number of different sized originals, the need was recognized for interchangeable copy paper cassettes designed for rapid and simple insertion into the copier, the cassettes being adapted to accept the sizes of copy paper normally encountered, such as 8 ½ × 11, 8 ½ × 13, and 8 ½ × 14, to enable rapid changeover of the machine to produce the desired size copies.

In providing a cassette for a convenience copier, a number of problems must be addressed. First the cassette must be rapidly and easily removable and insertable. Further, upon insertion, means must be provided to accurately position the cassette within the machine to enable proper operation of the sheet separator associated therewith. A mechanism must also be provided to assure that the cassette is securely locked in the machine. Once the copying operation begins, in a top feeder, means must be provided to maintain the top sheet in the stack in contact with the sheet feeder either by raising the sheets in the cassette into contact with the feeder, or by allowing the feeder to drop into the cassette or "eat its way" into the paper stack as the sheets are depleted.

In recent years, friction retard feeders having a feed belt in contact with the sheet to be fed, adapted to feed sheets from the stack through a retard throat formed by a portion of the feed belt and a stationary retard pad to prevent multiple sheet feeding has found increased acceptance. With this type of feeder, ordinarily the second sheet, or the sheet adjacent to the sheet being fed, is dragged partially into the nip formed by the feed belt and the retard pad. When this type of feeder is utilized with a cassette type paper tray, after the copy opertion is completed and the cassette is removed from the machine either to replenish the paper supply or to replace the cassette with a cassette containing different sized sheets, the sheet which has been dragged into the nip of the feeder may be held in the machine and be pulled out of the cassette as the cassette is removed. Thus, the operator must reach into the machine and remove this sheet prior to reinsertion of a cassette, or if this sheet is not completely pulled out of the cassette, the sheet must be carefully fed back into the cassette before the cassette can be reinserted.

Another problem encountered with friction retard feeders is rapid wear of the friction retard pad since each sheet of paper fed from the machine is dragged across this pad.

It is therefore an object of the present invention to provide an improved copy sheet cassette for use in a convenience copier wherein the friction retard pad is mounted within the cassette, thereby maintaining all of the sheets within the confines of the cassette, even those which are dragged into the nip between the feed rolls and the retard pad to prevent retention of sheets in the machine upon the removal of the cassette. It is the further object of this invention to provide a cassette adapted for secure and accurate location within a convenience copier and which is provided with means for holding the top sheet in the stack against the feed mechanism to provide the required normal force therebetween for optimum sheet feeding.

SUMMARY OF THE INVENTION

This invention relates to a copy sheet cassette for use in a reproduction machine utilizing a friction retard feeder, the cassette having a retard pad mounted therein for cooperation with the feeder, removal of the cassette from the machine thereby separating the retard pad from the feed belt or feed roller to pevent retention of sheets in the machine upon removal of the cassette.

DESCRIPTION OF THE PREFERRED EMBODIMENT

Figure 1:
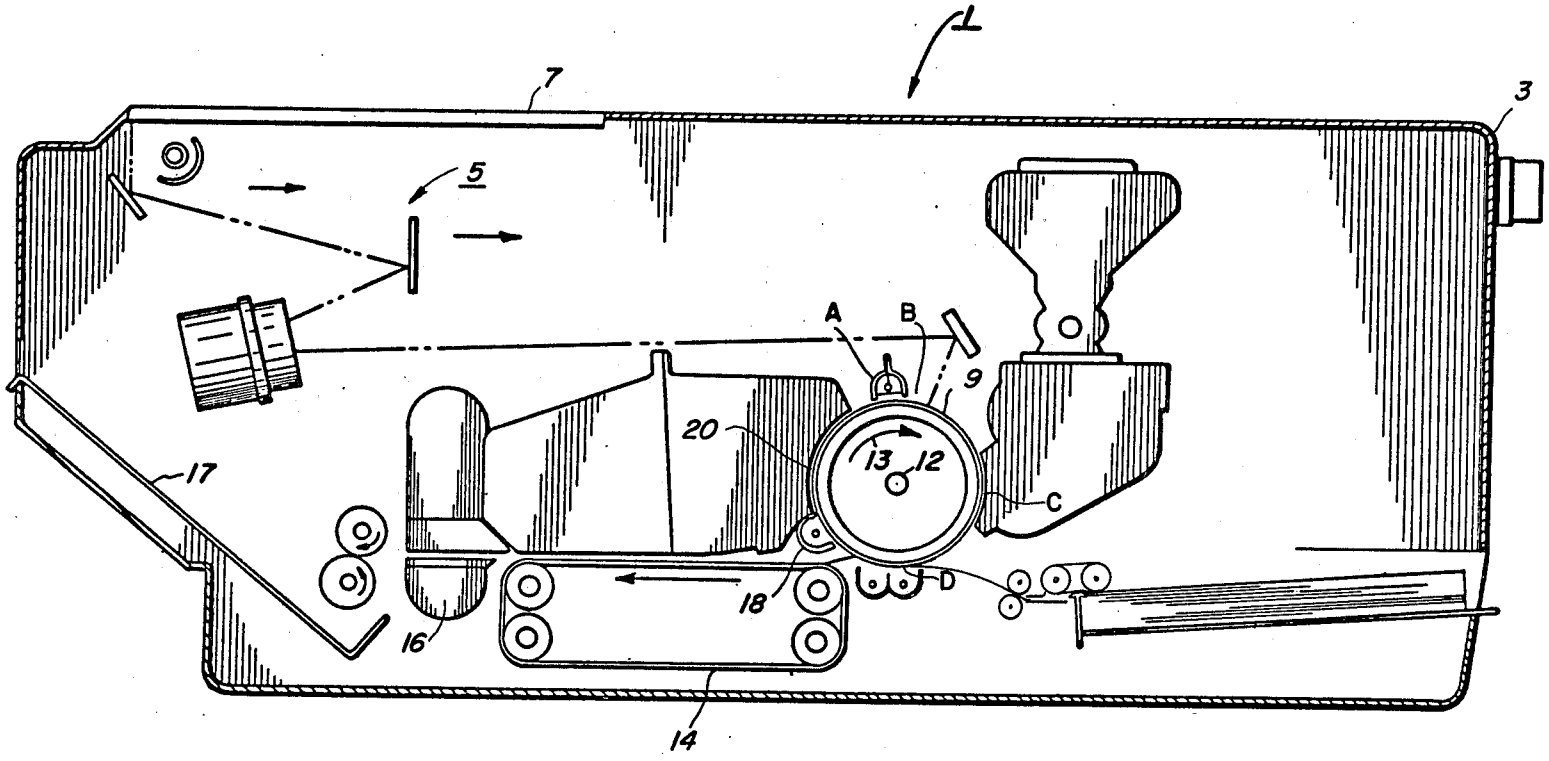
FIG. 1 is a schematic illustration of a xerographic reproduction machine employing a cassette-type handling mechanism of the present invention.

Referring to FIG. 1 of the drawings there is illustrated a xerographic reproduction machine 1 comprised of an outer housing member 3 containing the various well known elements of a xerographic reproduction machine including optic means 5 adapted to project an image of a document placed on platen 7 to a drum-type photoconductor 9. The photoconductor 9 is initially charged by a suitable corona emission device A after which it is exposed by projection of the document image thereon at the exposure zone B. Following exposure, the image is developed at a developing station C whereat electrically conductive toner particles are caused to adhere to the latent electrostatic image produced at the exposure station. After the latent electrostatic image is developed, it is transferred to a suitable support material such as copy paper at a transfer station D. The support material with the transferred image thereon is conveyed by suitable means such as conveyor 14 through a fusing mechanism 16 whereat the image is permanently affixed to the transfer material and thereafter ejected into a suitable catch tray 17. After transfer of the developed image to the support sheet, the photoconductor is discharged by a suitable discharge lamp 18 and residual toner material remaining thereon is removed at a cleaning station 20 to ready the photoconductor for subsequent copy cycles.

Figure 3:
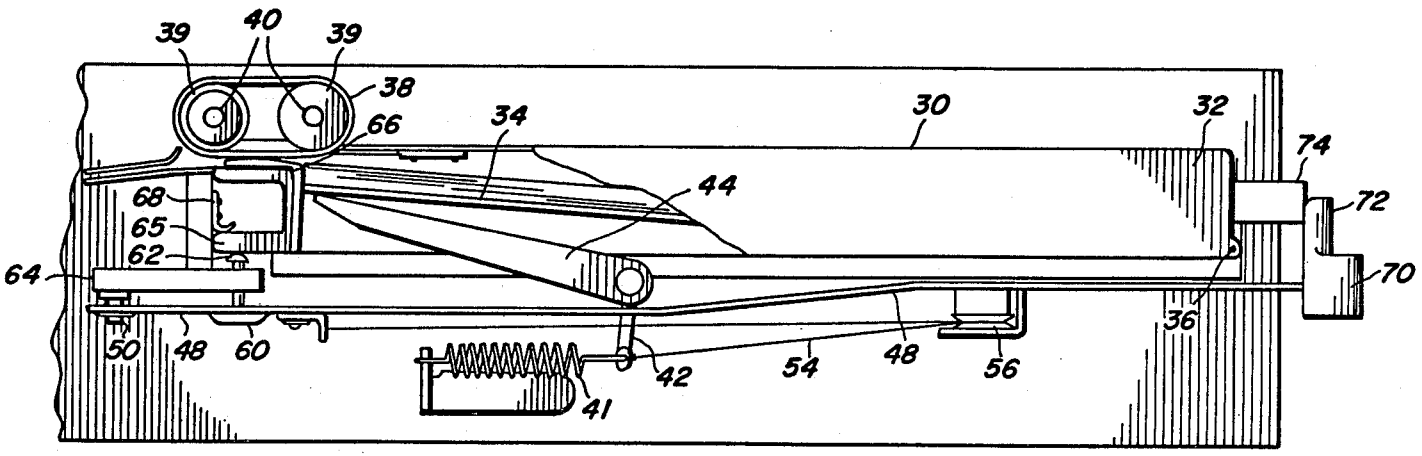
FIG. 3 is a side elevational view of the reproduction machine with portions thereof removed to illustrate the portion of the cassette adjacent the sheet separator mechanism and the interrelationship of the cassette therewith and, FIG. 4 is a bottom plan view of the sheet cassette.

Referring now to FIG. 3 there is illustrated a copy paper cassette mechanism having a top wall 30 and side walls 32. A bottom wall 34, adapted to support sheets of paper therein is pivoted from side walls 32 at pivot points 36. The bottom wall 34 is biased upwardly into engagement with a sheet feeding belt 38 by means of a bias spring 41 acting through pivoting levers 42 and 44, lever 44 directly contacting bottom wall 34 to transmit the biasing force of spring 41 thereto. In this manner, paper sheets, stacked on bottom wall 34 are pressed into engagement with a sheet feeding belt 38. The sheet feed belt 38, along with its supporting structure including rolls 39 and axes 40, and the biasing spring 41 along with its cooperating pivot arms 42 and 44 are permanently mounted within the xerographic machine for reasons to be hereinafter explained.

Figure 2:
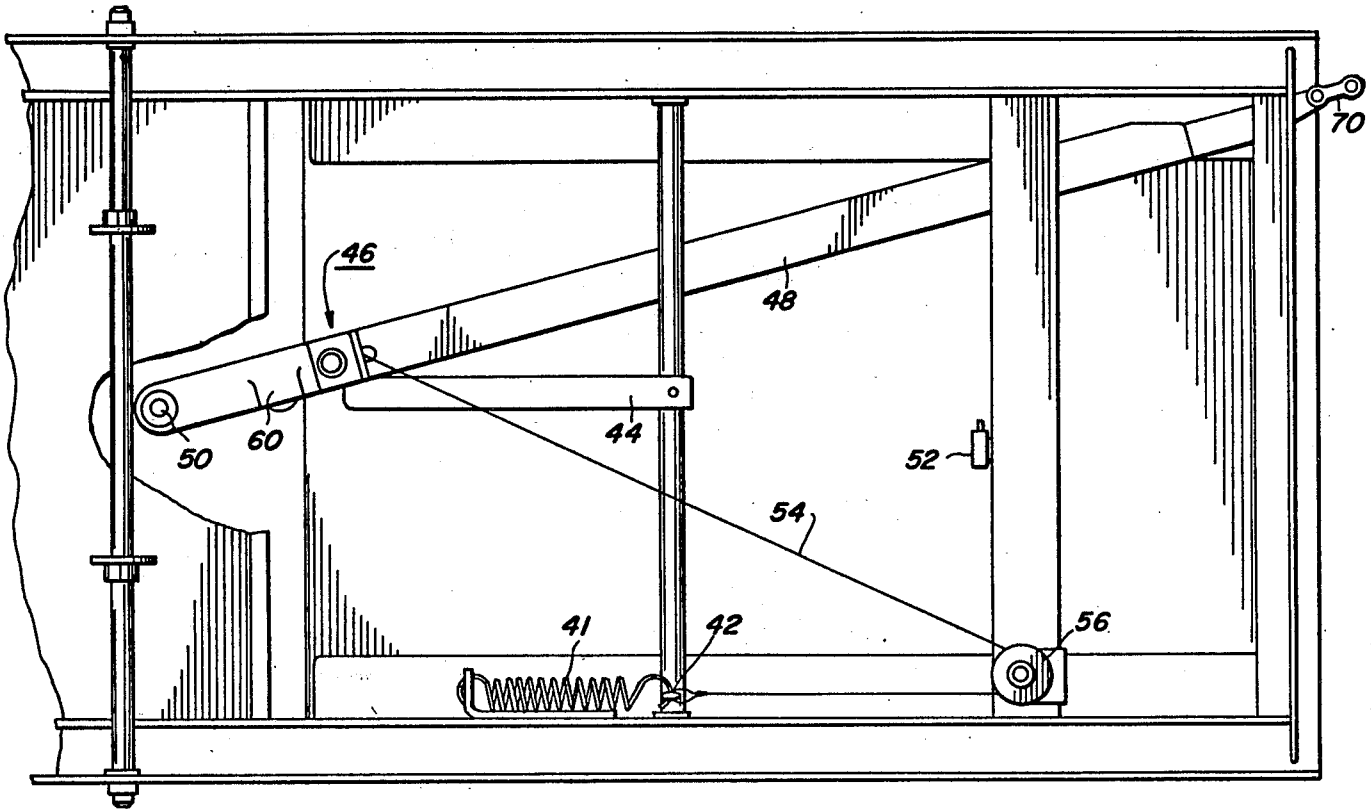
FIG. 2 is a bottom plan view of the portion of the reproduction machine adapted to receive the cassette-sheet handling mechanism, the sheet handling mechanism being removed therefrom for clarity.

A cassette locking and actuating lever mechanism 46 (best illustrated in FIG. 2) comprising a lever arm 48 pivotally attached to the machine frame at pivot 50 is adapted for movement from the cassette removal or insertion position illustrated in FIG. 2 to an operating position whereat the lever arm 48 is substantially parallel with the sides of the machine and in contact with a safety switch 52. A cable 54, attached to lever 48, is threaded around a pulley 56 and connected to one end of biasing spring 41 such that upon movement of lever 48 to the left as illustrated in FIG. 2, lever 44 will be pivoted downwardly to a position whereat the lever 44 will be clear of the cassette insertion or removal path. Lever 48 is also provided with a camming surface 60 adapted for contact with a cam follower 62 mounted for vertical movement in a portion 64 of the machine frame. Upon insertion of a cassette in the machine, and movement of lever 48 into operating position, the tension on cable 54 will be released, thereby allowing lever 44 to bias the cassette bottom 34 in an upward direction. At the same time, camming surface 60 will force cam follower 62 into contact with a lower front portion 65 of the cassette to force the cassette and the retard pad 66 mounted thereon into the proper position within the machine. A stop 68 is provided to accurately locate the front portion of the cassette within the machine, lever 48 being adapted to deflect or flex slightly when the cassette is raised into contact with stop 68. A hand grip 70 is provided on the end of lever 48, which hand grip is provided with an upwardly extending portion 72 adapted for contact with cassette handle 74 to provide a visual indication that the cassette is properly mounted within the reproduction machine and to prevent rearward motion of the cassette therefrom. Safety switch 52 may be connected to the reproduction machine control wiring to prevent operation of the machine unless the lever mechanism is in the operating position.

Figure 4:
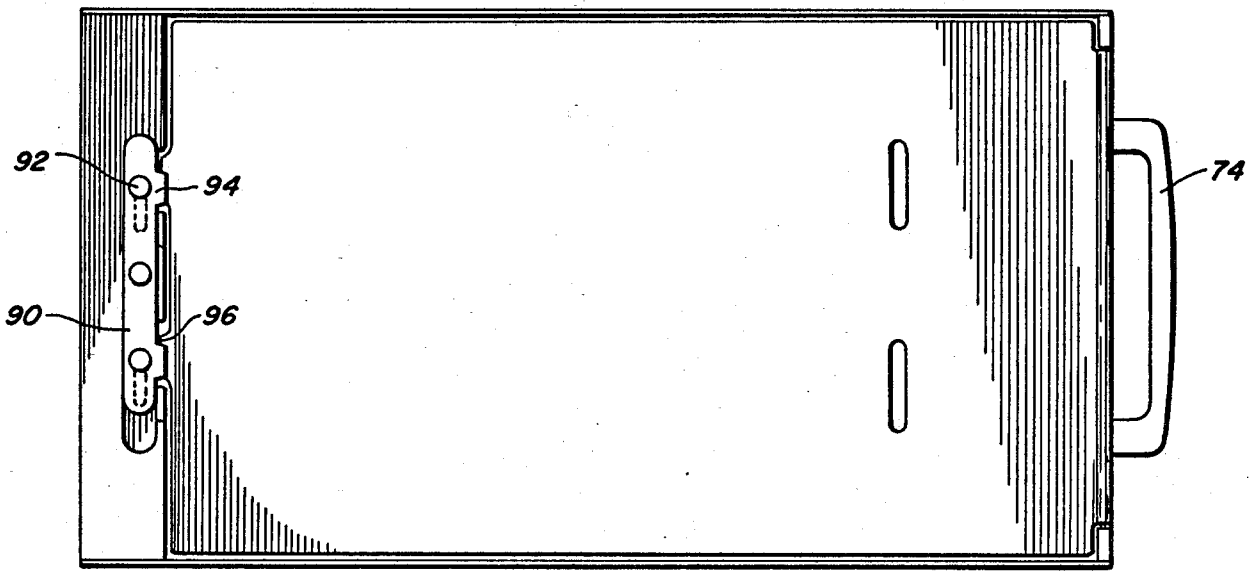

The cassette is adapted for loading from the bottom thereof. To accomplish this, a sliding lock member 90 is mounted on the forward stationary portion of the cassette by suitable fasteners such as rivets 92. The loc member 90 is provided with tabs 94 adapted for engagement with tabs 96 formed on bottom plate 34. Upon removal of the cassette from the machine, the cassette is inverted, locking member 90 is slid sideways to disengage tabs 94 from abs 96 and bottom plate 34 is pivoted toward the operator to allow reloading of sheets within the cassette. After insertion of the sheets, the bottom plate 34 is pivoted down into position and locked therein by sliding lock 90 back into the position illustrated in FIG. 4.

With the foregoing construction a number of advantages are obtained, all of which greatly enhance the reliability and ease of operation of the machine.

Since the reproduction machine ordinarily would be provided with a number of cassettes having different size sheets therein or to enable the machine operator to load sheets into one cassette while another cassette is being used, a number of retard pads equal to the number of cassettes results, thereby reducing the wear on any individual retard pad and maximizing the retard pad life. Further, by placing the retard pad on the cassettes, the condition thereof is easily checked by the machine operator or machine repairman and the retard pad may be easily replaced when necessary without requiring disassembly or access to the reproduction machine itself. Further, as stated heretofore, upon removal of the cassette, since the retard pad is lowered out of contact with the feed belt upon movement of lever 48 to the cassette removal or insertion position, the sheets queued in the retard nip will be removed with the cassette rather than being hung up in the machine as is common in machines employing stationary retard pads. Due to the novel construction of the cassette enabling a substantially constant biasing force to be applied to the bottom thereof to maintain the top sheet of paper in the cassette in the proper position relative to the feed belt and maintain a substantially constant normal force between the feed belt and the top sheet, substantially optimum sheet feeding conditions are maintained irregardless of the number of sheets in the cassette.

While the invention has been described with reference to the structure disclosed, it is not confined to the details set forth but is intended to cover such modifications or changes as may come within the scope of the following claims.

What is claimed is:

1. A reproduction machine having a copy sheet cassette adapted for insertion and removal from the machine for loading copy sheets therein comprising a cassette having a front wall, a rear wall, side walls and a top wall adapted to receive a stack of copy sheets therein, a bottom wall, adapted for pivotal movement toward and away from said top wall, a friction retard sheet feeder adapted for sequentially separating single copy sheets from the top of the copy sheet stack, said friction retard feeder comprising sheet separator means permanently mounted within the reproduction machine and friction retard means mounted on said front wall of the copy sheet cassette, means for positioning the front wall of the cassette within the reproduction machine to provide the required spacial relationship between said sheet separator means and said friction retard means, said positioning means including an abutment means formed on the front wall of said cassette and a corresponding abutment mounted within the reproduction machine;

a cassette locking lever moveable between a cassette locing position and a cassette removal position having a cam surface formed thereon adapted for cooperation with a cam follower to force the sheet cassette upwardly such that said abutment means on the wall of the cassette is moved into engagement with said abutment means mounted within the machine to accurately position the cassette within the machine and provide the required spacial relationship between said sheet separator means and said friction retard means when said locking lever is moved to the locking position; and, biased lever means adapted for contact with said bottom wall of the cassette to bias said bottom wall in an upward direction to maintain the top sheet in the copy sheet stack in contact with said sheet separator means irrespective of the quantity of copy sheets in the sheet cassette.

2. A reproduction machine according to claim 1 wherein said biased lever means comprises pivotal lever means mounted within the reproduction machine and operatively connected to said locking lever, movement of said locking lever into the locking position causing said pivotal lever to contact the pivotal bottom wall of said copy sheet cassette to bias the bottom wall and the copy sheet thereon into engagement with said sheet separator means.

3. A reproduction machine according to claim 2 wherein said locking lever is provided with a hand grip having an upwardly extending portion thereon adapted for contact with said cassette to prevent removal of the cassette from the machine when said lever is moved to the locking position.

* * * * *